US010257633B1

(12) United States Patent
Ho et al.

(10) Patent No.: US 10,257,633 B1
(45) Date of Patent: Apr. 9, 2019

(54) SOUND-REPRODUCING METHOD AND SOUND-REPRODUCING APPARATUS

(71) Applicant: HTC Corporation, Taoyuan (TW)

(72) Inventors: Chi-Tang Ho, Taoyuan (TW); Li-Yen Lin, Taoyuan (TW); Tsung-Yu Tsai, Taoyuan (TW); Chun-Min Liao, Taoyuan (TW); Yan-Min Kuo, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 15/705,295

(22) Filed: Sep. 15, 2017

(51) Int. Cl.
*H04S 5/00* (2006.01)
*H04S 7/00* (2006.01)

(52) U.S. Cl.
CPC ..... *H04S 5/00* (2013.01); *H04S 7/30* (2013.01); *H04S 2400/11* (2013.01)

(58) Field of Classification Search
CPC ..... H04S 5/00; H04S 7/30; H04S 2400/11; H04R 5/02
USPC ..... 381/1, 17, 56, 58, 303
See application file for complete search history.

(56) References Cited

U.S. PATENT DOCUMENTS

2013/0051572 A1* 2/2013 Goh ..... H04S 7/302 381/59
2015/0237446 A1* 8/2015 Katayama ..... H04R 1/323 381/163
2015/0263693 A1* 9/2015 Bush ..... H03G 5/165 381/56
2015/0332510 A1* 11/2015 Jovanovic ..... G06T 15/20 345/427

FOREIGN PATENT DOCUMENTS

| | | | |
|---|---|---|---|
| TW | I453451 | B | 9/2014 |
| TW | I456569 | B | 10/2014 |
| TW | I479905 | B | 4/2015 |
| TW | I492096 | B | 7/2015 |
| TW | I528841 | B | 4/2016 |
| TW | I532386 | B | 5/2016 |
| TW | M524035 | U | 6/2016 |
| TW | I561089 | B | 12/2016 |

* cited by examiner

*Primary Examiner* — William A Jerez Lora
(74) *Attorney, Agent, or Firm* — CKC & Partners Co., LLC

(57) ABSTRACT

A sound-reproducing method that includes the steps outlined below is provided. A playback sound is generated by applying original audio into a test environment. The playback sound is received to generate received sound data. At least one test environment spatial parameter corresponding to the test environment is calculated according to known audio data related to the original audio and the received sound data. Input audio is modified by applying the test environment spatial parameter thereto to generate reproduced audio.

14 Claims, 3 Drawing Sheets

SOUND-REPRODUCING METHOD AND SOUND-REPRODUCING APPARATUS

BACKGROUND

Field of Invention

The present disclosure relates to a sound-reproducing technology. More particularly, the present disclosure relates to a sound-reproducing method and a sound-reproducing apparatus.

Description of Related Art

Spatial and surround sound audio processing is becoming a more common feature of video and other audio playing devices. The audio file for playback may not include spatial information. In some conventional approaches, equalizer is used to modify the frequency response of the audio file manually to accomplish the spatial effect of the playback result. However, such approaches are not efficient and may not reflect the actual condition of the environment.

Accordingly, what is needed is a sound-reproducing method and a sound-reproducing apparatus to address the issues mentioned above.

SUMMARY

An aspect of the present disclosure is to provide a sound-reproducing method that includes the steps outlined below. A sound-reproducing method that includes the steps outlined below is provided. A playback sound is generated by applying original audio into a test environment. The playback sound is received to generate received sound data. At least one test environment spatial parameter corresponding to the test environment is calculated according to known audio data related to the original audio and the received sound data. Input audio is modified by applying the test environment spatial parameter thereto to generate reproduced audio.

Another aspect of the present disclosure is to provide a sound-reproducing apparatus. The sound-reproducing apparatus includes a memory, a playback module, a sound-receiving module and a processing module. The memory is configured to store a computer program code. The processing module is electrically coupled to the memory, the playback module and the sound-receiving module and configured to execute the computer program code to perform a sound-reproducing method that includes the steps outlined below. A playback sound is generated by applying original audio into a test environment. The playback sound is received to generate received sound data. At least one test environment spatial parameter corresponding to the test environment is calculated according to known audio data related to the original audio and the received sound data. Input audio is modified by applying the test environment spatial parameter thereto to generate reproduced audio.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
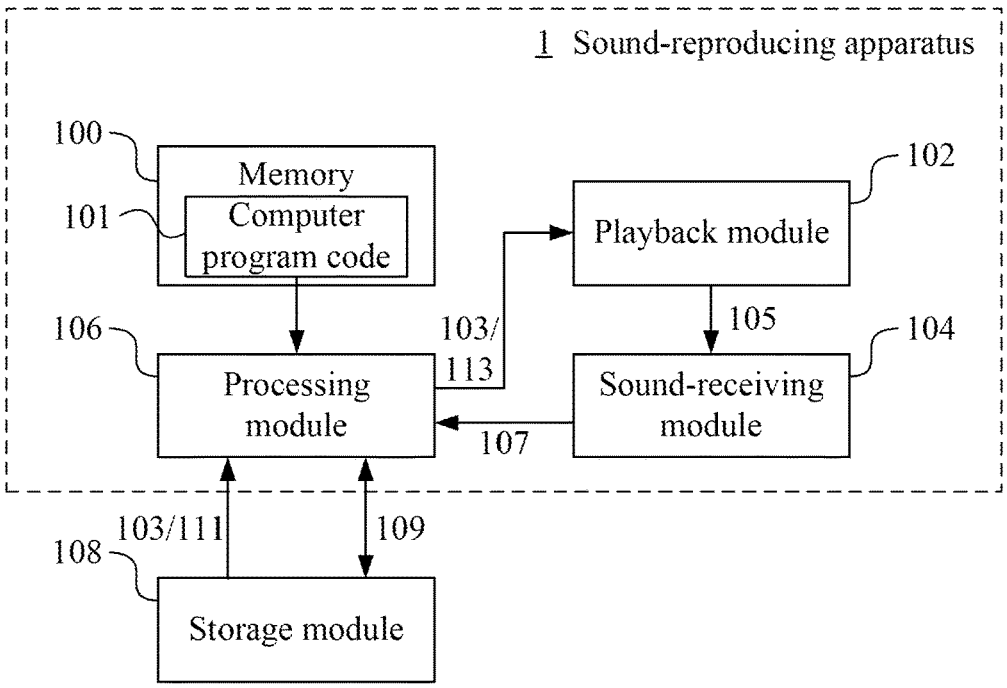
FIG. 1 is a block diagram of a sound-reproducing apparatus in an embodiment of the present disclosure.

Reference is made to FIG. 1. FIG. 1 is a block diagram of a sound-reproducing apparatus 1 in an embodiment of the present disclosure. The sound-reproducing apparatus 1 includes a memory 100, a processing module 102, a playback module 104 and a sound-receiving module 106.

The memory 100 may include any suitable elements for storing data and machine-readable instructions, such as, but not limited to read only memory, random access memory, erasable programmable read only memory, electrically erasable programmable read only memory, a hard drive, a removable media drive for handling compact disks, digital video disks, diskettes, magnetic tape cartridges, memory cards, and the like.

The playback module 104 may be any module that is able to playback a sound signal, such as, but not limited to a loud-speaker or an amplifier. The sound-receiving module 106 may be any module that is able to receive a sound signal, such as, but not limited to a microphone.

The processing module 102 is electrically coupled to the memory 100, the playback module 104 and the sound-receiving module 106. The processing module 102, as used herein, may be any type of computational circuit such as, but not limited to, a microprocessor, microcontroller, complex instruction set computing microprocessor, reduced instruction set computing microprocessor, very long instruction word microprocessor, explicitly parallel instruction computing microprocessor, graphics processor, digital signal processor, or any other type of processing circuit. The processing module 102 may also include embedded controllers, such as generic or programmable logic devices or arrays, application specific integrated circuits, single-chip computers, and the like.

In an embodiment, the memory 100 is configured to store a computer program code 101 and may be in communication to and executed by the processing module 102. When executed by the processing module 102, the computer program code 101 causes the processing module 102 to operate the sound-reproducing apparatus 1.

Figure 2:
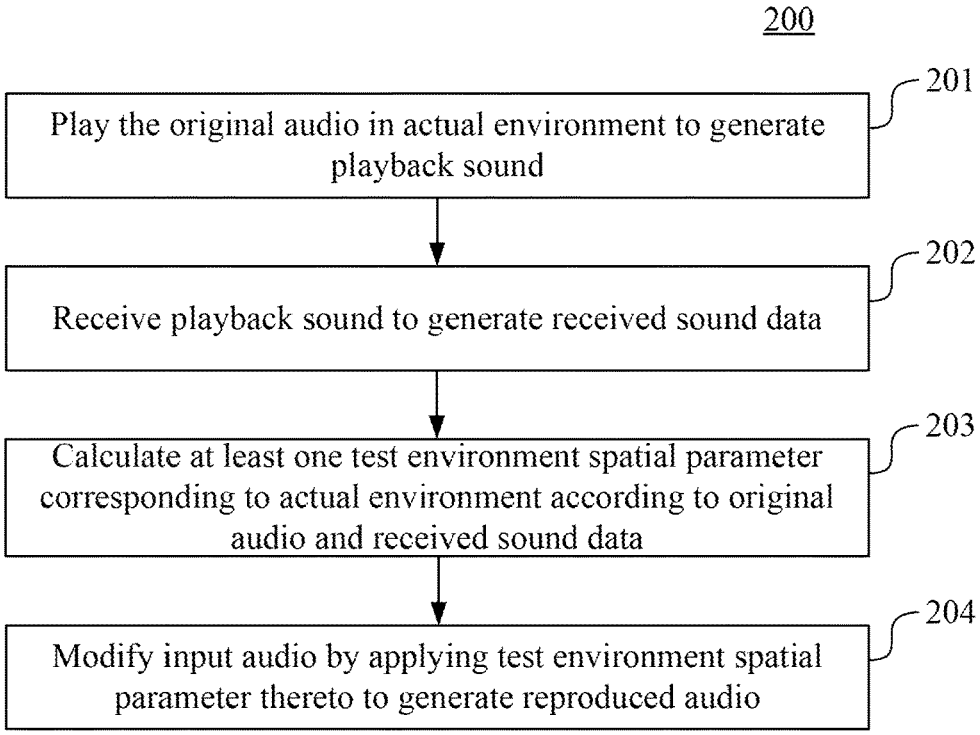
FIG. 2 is a sound-reproducing method in an embodiment of the present invention.

Reference is now made to FIG. 2. FIG. 2 is a sound-reproducing method 200 in an embodiment of the present invention. The sound-reproducing method 200 can be used in the sound-reproducing apparatus 1 illustrated in FIG. 1. More specifically, in an embodiment, the processing module 102 is configured to execute the computer program code 101 stored in the memory 100 to perform the sound-reproducing method 200. The detail of the sound-reproducing method 200 illustrated in FIG. 2 is described in accompany with FIG. 1.

The sound-reproducing method 200 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 201, a playback sound 105 is generated by applying original audio 103 into a test environment.

More specifically, the playback module 104 is controlled to play the original audio 103 on ambient sound corresponding to the test environment by the processing module 102 to generate the playback sound 105, in which the test environment is an actual environment.

In an embodiment, the original audio 103 is retrieved from such as, but not limited to a storage module 108, in which the storage module 108 is either a local storage module disposed in the sound-reproducing apparatus 1 or a remote storage module disposed in a server.

Further, the original audio 103 may be a digital data. The sound-reproducing apparatus 1 may include modules such as, but not limited to a digital signal processing module and a digital-to-analog converter (not illustrated) to process the original audio 103 from the processing module 102 and convert the processed original audio 103 from the digital form to the analog form such that the playback module 104 plays the original audio 103 in the actual environment.

In step 202, the playback sound 105 is received to generate received sound data 107.

More specifically, in an embodiment, the sound-receiving module 106 is controlled to receive the playback sound 105 by the processing module 102 to generate the received sound data 107.

In an embodiment, the sound-receiving module 106 may be such as, but not limited to a microphone. The sound-reproducing apparatus 1 may include modules such as, but not limited to an analog-to-digital converter and the digital signal processing module (not illustrated) to convert the playback sound 105 received by the sound-receiving module 106 from the analog form to the digital form and process the playback sound 105 to generate the received sound data 107. In an embodiment, the processing module 102 may retrieve and execute a sound-recording program code (not illustrated) from the memory 100 to record and store the received sound data 107.

It is appreciated that in an embodiment, the step 202 and the step 201 can be performed simultaneously. More specifically, when the playback module 104 is controlled to play the original audio 103, the sound-receiving module 106 is controlled to receive the playback sound 105 at the same time.

In step 203, at least one test environment spatial parameter 109 corresponding to the test environment is calculated according to the known audio data and the received sound data 107.

In the present embodiment, the known audio data includes at least one parameter of the original audio 103. The test environment spatial parameter 109 is calculated by the processing module 102 based on a division between the received sound data 107 and the original audio 103.

In an embodiment, the original audio 103 may include such as, but not limited to a chirp signal, an impulse signal, a music sound signal or a speech sound signal. The test environment spatial parameter 109 calculated therefrom may include a phase, a time difference between channels, a frequency response, an amplitude or a combination thereof related to the received sound data 107 and the original audio 103.

In an embodiment, the processing module 102 stores the test environment spatial parameter 109 in such as, but not limited to the storage module 108.

In step 204, input audio 111 is modified by applying the test environment spatial parameter 109 thereto by the processing module 102 to generate reproduced audio 113.

In an embodiment, the input audio 111 is retrieved from such as, but not limited to the storage module 108 as illustrated in FIG. 1, or from other sound input sources (not illustrated). Further, the processing module 102 may retrieve the stored test environment spatial parameter 109 from the storage module 108. The processing module 102 may use any suitable mathematic calculation method to apply the test environment spatial parameter 109 to the input audio 111.

The reproduced audio 113 can be played by any playback device such as, but not limited to the playback module 104 illustrated in FIG. 1, or by a headphone (not illustrated), in which the spatial quality of the actual environment can be reproduced on the reproduced audio 113.

The sound-reproducing apparatus 1 and the sound-reproducing method 200 of the present invention can calculate the test environment spatial parameter 109 corresponding to the actual environment and further apply the test environment spatial parameter 109 to other input audio 111 to generate the reproduced audio 113. The spatial quality of the actual environment can therefore be reproduced on the reproduced audio 113.

Figure 3:
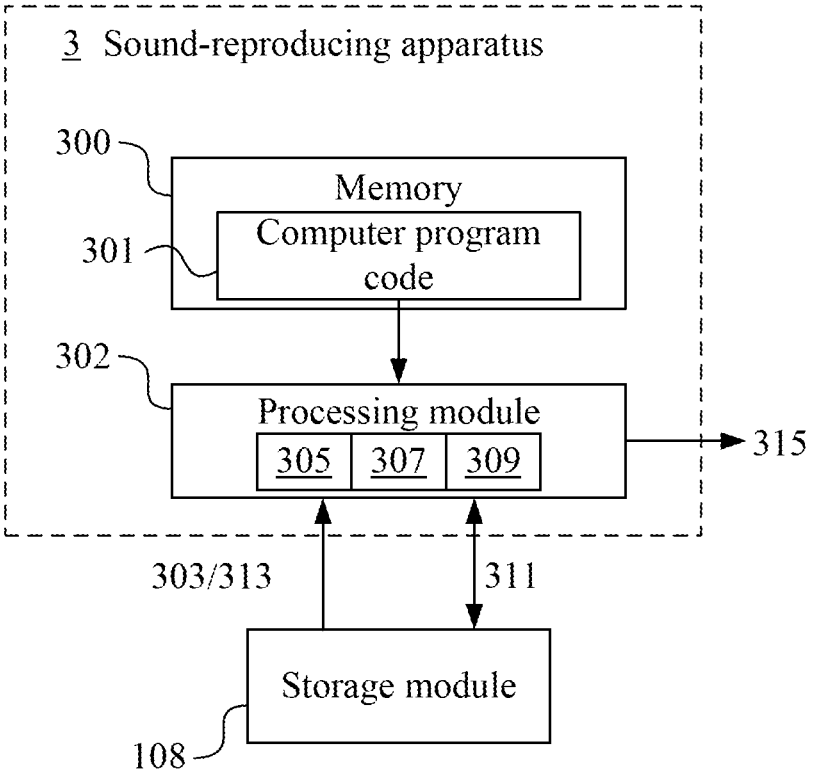
FIG. 3 is a block diagram of a sound-reproducing apparatus in an embodiment of the present disclosure.

Reference is made to FIG. 3. FIG. 3 is a block diagram of a sound-reproducing apparatus 3 in an embodiment of the present disclosure. The sound-reproducing apparatus 3 includes a memory 300 and a processing module 302.

The memory 300 may include any suitable elements for storing data and machine-readable instructions, such as, but not limited to read only memory, random access memory, erasable programmable read only memory, electrically erasable programmable read only memory, a hard drive, a removable media drive for handling compact disks, digital video disks, diskettes, magnetic tape cartridges, memory cards, and the like.

The processing module 302 is electrically coupled to the memory 300. The processing module 302, as used herein, may be any type of computational circuit such as, but not limited to, a microprocessor, microcontroller, complex instruction set computing microprocessor, reduced instruction set computing microprocessor, very long instruction word microprocessor, explicitly parallel instruction computing microprocessor, graphics processor, digital signal processor, or any other type of processing circuit. The processing module 302 may also include embedded controllers, such as generic or programmable logic devices or arrays, application specific integrated circuits, single-chip computers, and the like.

In an embodiment, the memory 300 is configured to store a computer program code 301 and may be in communication to and executed by the processing module 302. When executed by the processing module 302, the computer program code 301 causes the processing module 302 to operate the sound-reproducing apparatus 3.

Figure 4:
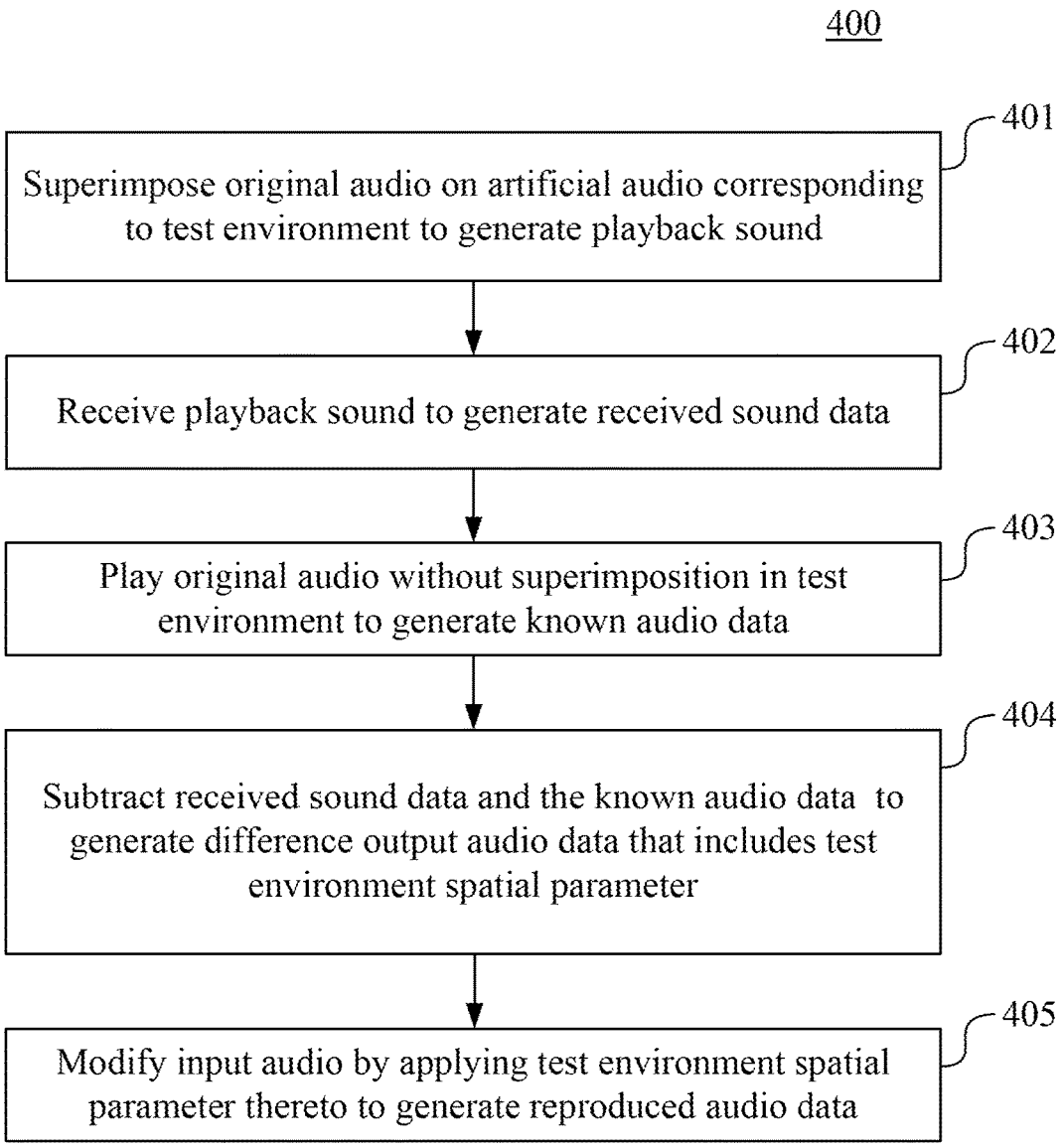
FIG. 4 is a sound-reproducing method in an embodiment of the present invention.

Reference is now made to FIG. 4. FIG. 4 is a sound-reproducing method 400 in an embodiment of the present invention. The sound-reproducing method 400 can be used in the sound-reproducing apparatus 3 illustrated in FIG. 3. More specifically, in an embodiment, the processing module 302 is configured to execute the computer program code 301 stored in the memory 300 to perform the sound-reproducing method 400. The detail of the sound-reproducing method 400 illustrated in FIG. 4 is described in accompany with FIG. 3.

The sound-reproducing method 400 includes the steps outlined below (The steps are not recited in the sequence in which the steps are performed. That is, unless the sequence of the steps is expressly indicated, the sequence of the steps is interchangeable, and all or part of the steps may be simultaneously, partially simultaneously, or sequentially performed).

In step 401, a playback sound 305 is generated by applying original audio 303 into a test environment. In an embodiment, the test environment is a virtual environment that is a computer-generated virtual reality environment that is operated by such as, but not limited to the processing module 302.

More specifically, the original audio 303 is superimposed on artificial audio (not illustrated) corresponding to the test environment to generate the playback sound 305.

In an embodiment, the original audio 303 is retrieved from such as, but not limited a storage module 304, in which the storage module 304 is either a local storage module disposed in the sound-reproducing apparatus 3 or a remote storage module disposed in a server.

In step 402, the playback sound 305 is received to generate received sound data 307.

In step 403, the original audio 303 without superimposition is played in the test environment to generate known audio data 305 by the processing module 302.

In step 404, at least one test environment spatial parameter 311 corresponding to the test environment is calculated according to the known audio data 305 and the received sound data 107.

More specifically, the received sound data 307 and the known audio data 305 are subtracted to generate difference output audio data 309 that includes the test environment spatial parameter 311 by the processing module 302.

In an embodiment, the original audio 303 may include such as, but not limited to a chirp signal, an impulse signal, a music sound signal or a speech sound signal. The test environment spatial parameter 311 calculated therefrom may include a phase, a time difference between channels, a frequency response, an amplitude or a combination thereof related to the difference output audio data 309 and the original audio 303.

In an embodiment, the processing module 302 stores the test environment spatial parameter 311 in such as, but not limited to the storage module 304.

In step 405, input audio data 313 is modified by applying the test environment spatial parameter 311 thereto by the processing module 102 to generate reproduced audio data 315.

In an embodiment, the input audio data 313 is retrieved from such as, but not limited to the storage module 304 illustrated in FIG. 3, or from other sound input sources (not illustrated). The processing module 302 may use any suitable mathematic calculation method to apply the test environment spatial parameter 311 to the input audio data 313.

In an embodiment, the reproduced audio data 315 can be played by any playback device such as, but not limited to a playback module or a headphone (not illustrated), in which the spatial quality of the virtual environment can be reproduced on the reproduced audio data 315.

The sound-reproducing apparatus 3 and the sound-reproducing method 400 of the present invention can calculate the reproduced audio data 315 corresponding to the virtual environment and further apply the reproduced audio data 315 to other input audio data 313 to generate the reproduced audio data 315. The spatial quality of the virtual environment can therefore be reproduced on the reproduced audio data 315.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A sound-reproducing method, comprising:

generating a playback sound by applying original audio into a test environment, wherein the test environment is a virtual environment;

receiving the playback sound to generate received sound data;

calculating at least one test environment spatial parameter corresponding to the test environment according to the received sound data and known audio data related to the original audio; and modifying input audio by applying the test environment spatial parameter thereto to generate reproduced audio.

2. The sound-reproducing method of claim 1, wherein the step of generating the playback sound further comprises:

superimposing the original audio on an artificial audio corresponding to the test environment to generate the playback sound.

3. The sound-reproducing method of claim 2, further comprising:

subtracting the received sound data and the known audio data to generate difference output audio data, wherein the difference output audio data comprises the at least one test environment spatial parameter.

4. The sound-reproducing method of claim 1, further comprising storing the test environment spatial parameter.

5. The sound-reproducing method of claim 1, wherein the test environment spatial parameter comprises a phase, a time difference between channels, a frequency response, an amplitude or a combination thereof related to the received sound data and the known audio data.

6. The sound-reproducing method of claim 1, wherein the original audio comprises a chirp signal, an impulse signal, a music sound signal or a speech sound signal.

7. The sound-reproducing method of claim 1, wherein the test environment spatial parameter is calculated based on a division between the received sound data and the original audio.

8. A sound-reproducing apparatus, comprising:

a memory configured to store a computer program code; and a processing module electrically coupled to the memory, a playback module and a sound-receiving module and configured to execute the computer program code to perform a sound-reproducing method comprising:

generating a playback sound by applying original audio into a test environment, wherein the test environment is a virtual environment;

receiving the playback sound to generate received sound data;

calculating at least one test environment spatial parameter corresponding to the test environment according to known audio data related to the original audio and the received sound data; and modifying input audio data by applying the test environment spatial parameter thereto to generate reproduced audio.

9. The sound-reproducing apparatus of claim 8, wherein the step of generating the playback sound further comprises:

superimposing the original audio on an artificial audio corresponding to the test environment to generate the playback sound, wherein the test environment is a virtual environment.

10. The sound-reproducing apparatus of claim 9, wherein the sound-reproducing method further comprises:

subtracting the received sound data and the known audio data to generate difference output audio data, wherein the difference output audio data comprises the at least one test environment spatial parameter.

11. The sound-reproducing apparatus of claim 8, wherein the sound-reproducing method further comprises storing the test environment spatial parameter.

12. The sound-reproducing apparatus of claim 8, wherein the test environment spatial parameter comprises a phase, a time difference between channels, a frequency response, an amplitude or a combination thereof related to the received sound data and the known audio data.

13. The sound-reproducing apparatus of claim 8, wherein the original audio comprises a chirp signal, an impulse signal, a music sound signal or a speech sound signal.

14. The sound-reproducing apparatus of claim 8, wherein the test environment spatial parameter is calculated based on a division between the received sound data and the original audio.

* * * * *